US005429279A

United States Patent [19]

Van Der Heijden

[11] Patent Number: 5,429,279

[45] Date of Patent: Jul. 4, 1995

[54] MIXING CHAMBER FOR MIXING TOGETHER A GASEOUS AND A LIQUID CONSTITUENT

[75] Inventor: Edgar I. M. Van Der Heijden, Alkmaar, Netherlands

[73] Assignee: Airspray International B.V., Beverwijk, Netherlands

[21] Appl. No.: 150,198

[22] PCT Filed: May 25, 1992

[86] PCT No.: PCT/NL92/00089

§ 371 Date: Dec. 9, 1993

§ 102(e) Date: Dec. 9, 1993

[87] PCT Pub. No.: WO92/22477

PCT Pub. Date: Dec. 23, 1992

[30] Foreign Application Priority Data

Jun. 11, 1991 [NL] Netherlands ..... 9101009

[51] Int. Cl.[6] ..... B65D 83/14

[52] U.S. Cl. ..... 222/402.18; 222/189.06

[58] Field of Search ..... 222/136, 187, 189, 190, 222/402.18, 402.1, 464, 564; 239/337, 369, 575

[56] References Cited

U.S. PATENT DOCUMENTS

| | | | |
|---|---|---|---|
| 3,069,098 | 12/1962 | Frangos et al. | 22/402.18 X |
| 3,131,834 | 5/1964 | Meshberg | 222/399 |
| 3,159,318 | 12/1964 | Green | 222/402.18 |
| 3,583,606 | 6/1971 | Ewald | 222/402.18 |
| 3,658,215 | 4/1972 | Ewald | 222/464 X |
| 3,970,219 | 7/1976 | Spitzer et al. | 222/136 X |
| 4,061,252 | 12/1977 | Riccio | 222/402.18 |
| 4,141,472 | 2/1979 | Spitzer et al. | 222/402.18 X |
| 4,142,652 | 3/1979 | Platt | 222/189 |
| 4,227,631 | 10/1980 | Scheider | 222/635 |
| 4,396,152 | 8/1983 | Abplanalp | 222/402.18 X |
| 4,418,846 | 12/1983 | Pong et al. | 222/189 |
| 4,431,119 | 2/1984 | Stoody | 222/148 |
| 4,940,171 | 7/1990 | Gilroy | 222/402.18 |
| 5,337,929 | 8/1994 | Van Der Heijden | 222/402.18 |

FOREIGN PATENT DOCUMENTS

| | | | |
|---|---|---|---|
| 0508860 | 10/1992 | European Pat. Off. . | |
| 2347546 | 3/1975 | Germany . | |
| 2014248 | 8/1979 | United Kingdom | 222/402.18 |
| 2018908 | 10/1979 | United Kingdom | 222/402.18 |
| 2060080 | 4/1981 | United Kingdom . | |
| WOA9101259 | 2/1991 | WIPO . | |

*Primary Examiner*—Kevin P. Shaver
*Attorney, Agent, or Firm*—Henderson & Sturm

[57] ABSTRACT

An apparatus including a mixing chamber for mixing together pressurized gaseous and liquid constituents, the mixing chamber including a lower region and an upper region; separate feed connections for the pressurized constituents of a mixture to be formed; a discharge connection for discharging a formed mixture to a chamber, wherein at least one of the separate feed connections includes passages in a wall of the mixing chamber; a spring located in the lower region of the mixing chamber biased against a pressure element located in the upper region of the mixing chamber, wherein the pressure element and an inner wall of the upper region of the mixing chamber define an annular space around the pressure element, wherein the passages comprise a porous part in the wall of the mixing chamber that open into the annular space around the pressure element in the upper region of the mixing chamber, and comprises an inlet for a pressurized gaseous constituent; and wherein the lower region of the mixing chamber comprises an inlet for a pressurized liquid component.

14 Claims, 2 Drawing Sheets

MIXING CHAMBER FOR MIXING TOGETHER A GASEOUS AND A LIQUID CONSTITUENT

The present invention relates to a mixing chamber for mixing together a pressurised gaseous and liquid constituent, which mixing chamber is provided with separate feed connections for the pressurised constituents of the mixture to be formed, and with a discharge connection for the mixture formed to a chamber with lower pressure, at least one of the feed connections being formed by narrow passages in the wall of the mixing chamber.

The mixing together of a gas and a liquid with a view to forming a fine mist can lead to difficulties if the fine droplets formed in a spray nozzle merge into larger droplets in the jet. This leads to an irregular distribution of the liquid on a sprayed surface. If a propellant which dissolves in the liquid and evaporates easily again from it is used, this merging can be avoided, but there is an increasing objection to the use of such propellants on account of their harmful effects on the environment, or on account of their combustibility.

If air is used as the propellant, mixing it well with the liquid by turbulence in a mixing chamber can actually prevent the droplets formed from merging, but it is difficult to obtain a good mix in the case of small mixing chambers. This applies in particular in the case of aerosols in which the mixing chamber with the dispensing valve and the spray nozzle has to be combined to a small unit for placing on an aerosol. This stands in the way of a more widespread use of aerosols working with air as the propellant, so that the aerosols with harmful propellants still remain in general use. A likely ban on the latter aerosols in the future is part of the reason why there is a great need for a solution to this problem. Besides, this mixing problem is not limited to aerosols, and finding a solution for such aerosols can lead to applications in other fields.

One solution is described in NL-A-89 01877 of Applicant, which describes a mixing chamber made up of two parts which have surfaces touching each other and abutting the inside wall of the mixing chamber. The narrow passages are in this case formed by grooves in at least one of the abutting surfaces which together with the other surface bound the narrow passages.

The present invention provides another simple solution to the provision of narrow passages in the wall of the mixing chamber, and to that end is characterised in that the narrow passages are formed by at least one porous part present locally in the wall of the mixing chamber.

It has in fact been found that through the use of such a porous part with narrow passages a mixing suitable for the abovementioned purpose can be obtained, in which the dimensions of the passages can depend on the viscosity of the liquid and the dimensions and layout of the assembly of mixing chamber and discharge means connected to it.

The invention also relates to an aerosol intended for atomising a liquid by means of a propellant, in particular air, which aerosol contains a mixing chamber according to the invention.

The invention will be explained in greater detail below with reference to the appended drawing, in which.

Figure 1:
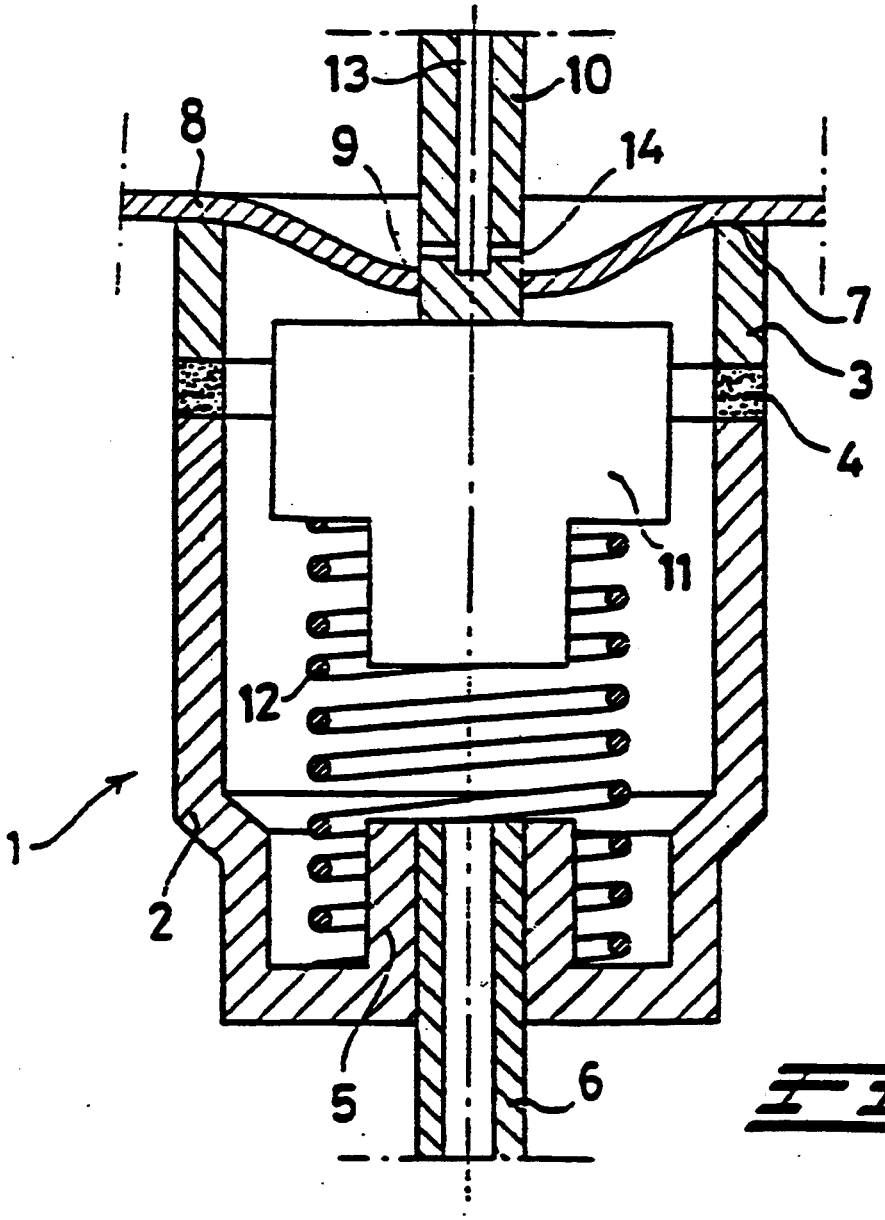
FIG. 1 shows a schematic section of an example of an embodiment of a mixing chamber according to the invention.
Figure 2:
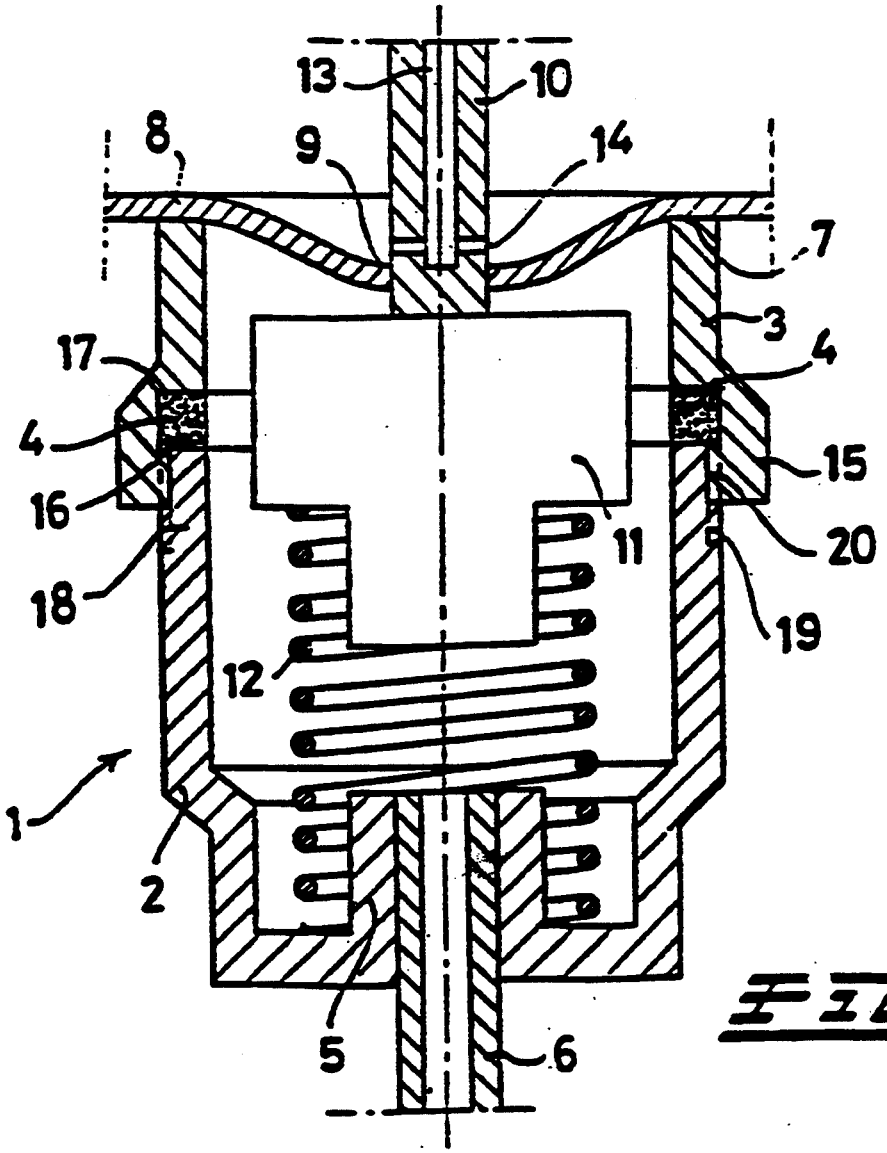
FIG. 2 shows a schematic section of another example of an embodiment of a mixing chamber according to the invention.

The mixing chambers shown in FIGS. 1 and 2 form a part of an aerosol not shown in any further detail. The mixing chamber 1 in FIG. 1 comprises a beaker-shaped bottom part 2 and an annular top piece 3, separated by an annular porous part 4, which can be, for example, a porous plastic, a sintered material, or a porous ceramic material. Apart from materials with a relatively random pore distribution, materials which are provided in a very accurate way with narrow passages are also suitable. An example which can be mentioned in this connection is plastic which is provided with narrow passages using a laser, which passages nave a very accurately determined orientation and size.

It will be clear that the position and dimensions of the porous part 4 depend on the use, and can be altered if desired. The porous part 4 can comprise, for example, several smaller porous parts distributed over the periphery of the mixing chamber 1.

The beaker 2 is provided at the bottom side with a connecting spout 5 for an immersion tube 6 which is immersed in the liquid present in the aerosol.

The top edge 7 of the top piece 3 is in sealing contact with a sealing ring 8, which forms part of the release valve assembly of the aerosol. The bottom end of a hollow stem 10, which is connected to the spray head of the aerosol, projects into a central opening 9 of this ring 8. The bottom side of this stem 10 is connected to a pressure element 11, which is pressed upwards by means of a spring 12 resting against the bottom of the beaker 2, while the top position is bounded by a stop, which is not shown.

In the case shown, the longitudinal bore 13 of the stem 10 is connected at two sides to the outside by means of a transverse bore 14, which in the situation shown lies above the sealing ring 8. The number of transverse bore openings can also be greater or smaller. On pressing in the stem 10, it slides into the opening 9, and the transverse bore 14 comes to lie at the other side of the ring 8, so that the longitudinal bore 13 then becomes connected to the inside of the mixing chamber.

After pressing in the stem 10, the pressure of the propellant will cause the liquid to be expelled from the aerosol through the tube 6 into the annular space around the element 11 of the mixing chamber 1, while the propellant also enters said space through the pores or narrow passages of the porous part 4. An turbulence then occurs, with the result that a good mixing of liquid and propellant is obtained, which will lead to a fine mist when the mixture emerges from the spray nozzle of the aerosol.

This is important particularly if air is used as the propellant, since air dissolves so little in the liquid to be atomised that the merging of droplets is not prevented. This can be avoided by mixing in air in the mixing chamber. In fact, this also applies to other propellants in which a mist formation without mixing in is inadequate.

The pores of the porous part 4 must have such a flow cross-section that good mixing takes place.

This also depends, of course, on the shape of the mixing chamber 1 and on the type of liquid to be atomised.

With a suitable selection of the flow cross-section of the pores or passages of the porous part 4 in relation to the size of the immersion tube 6 and/or the annular porous part 4 itself, an aerosol provided with such a mixing chamber is also found to work satisfactorily if it is held upside down and the pores or passages of the porous part 4 are thus connected to the liquid space and the tube 6 to the propellant chamber.

FIG. 2 shows a different embodiment of the mixing chamber according to the invention, in which the annular top piece 3 is provided with a collar 15, which fits on the top edge 16 of the beaker 2, while the internal diameter of the collar 15 corresponds to the external diameter of the top edge 16, and the internal diameter of the part of the top piece 3 abutting the collar 15 is equal to the internal diameter of at least top edge 16 of the tub 2.

The porous part 4 in this case is situated between the top edge 16 of the tub 2 and a shoulder 17 of the top piece 3. In order to ensure that the interior of the mixing chamber 1 can be connected by means of the porous part 4 to the outside of the mixing chamber where the propellant is situated, the outside wall of the top edge 18 of the beaker-shaped part 2 is provided with grooves 19 which with the collar 15 bound passages 20. It will be clear that the grooves 19 can also be formed in the collar 15.

It will be clear that the invention is not limited to the examples of embodiments described. For example, the wall of parts 2 or 3 can also be porous itself. A special embodiment in this respect is a mixing chamber which is integral with the porous part. This means that the mixing chamber comprises one unit and is locally porous. The mixing chamber can thus be made of, for example, plastic or the like, and can be provided locally with narrow passages. The mixing chamber could also be made entirely of a porous material. Finally, it is pointed out that the invention can be used anywhere similar problems occur.

I claim:

1. An apparatus comprising a mixing chamber for mixing together pressurized constituents comprising a gaseous constituent and a liquid constituent, said mixing chamber comprising a lower region and an upper region; separate feed connections for the pressurized constituents of a mixture to be formed; a discharge connection for discharging the formed mixture from the chamber, wherein at least one of said separate feed connections comprises passages in a wall of the mixing chamber; a spring located in said lower region of said mixing chamber biased against a pressure element located in said upper region of said mixing chamber, wherein said pressure element and an inner wall of said upper region of said mixing chamber define an annular space around said pressure element, and wherein said passages comprise a porous part in said wall of said mixing chamber that open into said annular space around said pressure element in said upper region of said mixing chamber, and comprise an inlet for the pressurized gaseous constituent, and wherein said lower region of said mixing chamber comprises an inlet for the pressurized liquid constituent.

2. The apparatus according to claim 1, wherein said mixing chamber is integral with said porous part.

3. The apparatus according to claim 1, wherein said porous part comprises material selected from a group consisting of sintered material, plastic material, and ceramic material.

4. The apparatus according to claim 3 wherein said mixing chamber is integral with said porous part.

5. The apparatus according to claim 1, further comprising a container for storing the gaseous and liquid constituents operably associated with said mixing chamber.

6. The apparatus according to claim 5, wherein said container comprises an aerosol container.

7. The apparatus according to claim 1, wherein said mixing chamber comprises a first part and a second part which are separated by said porous part.

8. The apparatus according to claim 7, wherein said first part of said mixing chamber is beaker-shaped and comprises at least one of said separate feed connections for one of said pressurized constituents said second part comprises a top piece fitting on an opening of said beaker-shaped first part, and said porous part is located between an end face of said top piece and an end face of said beaker-shaped first part and comprises another of said separate feed connections for another of said pressurized constituents.

9. The apparatus according to claim 8, wherein a member selected from the group consisting of said top piece and said beaker-shaped first part comprises a collar fitting around an outside wall of another member selected from said group consisting of said top piece and said beaker-shaped first part, and wherein a member selected from the group consisting of said outside wall and said collar comprises grooves which together with another member of said group consisting of said outside wall and said collar comprise said another of said at least one of said feed connections for said another of said pressurized constituents.

10. The apparatus according to claim 1, wherein said discharge connection of said mixing chamber comprises a hollow stem of a spray head comprising a bore connected by means of a release valve to said mixing chamber.

11. The apparatus according to claim 10, further comprising a container for storing the gaseous and liquid constituents operably associated with said mixing chamber.

12. The apparatus according to claim 11, wherein said container comprises an aerosol container.

13. An apparatus comprising a mixing chamber for mixing together pressurized constituents comprising a gaseous constituent and a liquid constituent, said mixing chamber comprising separate feed connections for the pressurized constituents of a mixture to be formed, and a discharge connection for discharging the formed mixture from the chamber, wherein at least one of said feed connections comprises passages in a wall of the mixing chamber, said passages comprising a porous part in said wall of the mixing chamber and separating said mixing chamber into at least a first part and a second part wherein said first part of said mixing chamber is beaker-shaped and comprises at least one of said separate feed connections for one of said pressurized constituents, and said second part comprises a top piece fitting on an opening of said beaker-shaped first part, and said porous part is located between an end face of said top piece and an end face of said beaker-shaped first part and comprises another of said separate feed connections for another of said pressurized constituents.

14. The apparatus according to claim 13, wherein a member selected from the group consisting of said top piece and said beaker-shaped first part comprises a collar fitting around an outside wall of another member selected from said group consisting of said top piece and said beaker-shaped first part, and wherein a member selected from the group consisting of said outside wall and said collar comprises grooves which together with another member of said group consisting of said outside wall and said collar comprise said another of said at least one of said feed connections for said another of said pressurized constituents.

* * * * *